US005137085A

United States Patent [19]

Goode

[11] Patent Number: 5,137,085

[45] Date of Patent: Aug. 11, 1992

[54] SIDE POCKET MANDREL

[75] Inventor: William B. Goode, Dallas, Tex.

[73] Assignee: Ot's Engineering Corporation, Carrollton, Tex.

[21] Appl. No.: 538,828

[22] Filed: Jun. 15, 1990

[51] Int. Cl.[5] ..... E21B 23/03

[52] U.S. Cl. ..... 166/117.5; 166/242

[58] Field of Search ..... 166/117.5, 242; 137/155

[56] References Cited

U.S. PATENT DOCUMENTS

| | | | |
|---|---|---|---|
| 2,679,903 | 6/1954 | McGowen etal. . | |
| 2,824,525 | 2/1958 | McGowen, Jr. . | |
| 2,941,599 | 6/1960 | Daffin . | |
| 2,942,671 | 6/1960 | Schramm . | |
| 2,948,341 | 8/1960 | Fredd | 166/218 |
| 2,964,110 | 12/1960 | Garwood et al. | 166/241 |
| 2,988,146 | 6/1961 | Fredd | 166/117.5 |
| 3,353,607 | 11/1967 | Kinley | 166/117.5 |
| 3,353,608 | 11/1967 | Beebe et al. | 166/117.5 |
| 3,417,774 | 12/1968 | Douglas et al. | 137/155 |
| 3,561,528 | 2/1971 | Butler et al. | 166/117.5 |
| 3,561,535 | 2/1971 | Butler et al. | 166/117.5 X |
| 3,603,393 | 9/1971 | Terral et al. | 166/242 |
| 3,610,336 | 10/1971 | Sizer | 166/117.6 |
| 3,665,955 | 5/1972 | Conner | 137/495 |
| 3,713,483 | 1/1973 | Robicheaux | 166/117.5 |
| 3,727,683 | 4/1973 | Terral et al. | 166/117.5 |
| 3,741,299 | 6/1973 | Terral | 166/117.5 |
| 3,741,601 | 6/1973 | Dudley | 294/86.18 |
| 3,752,231 | 8/1973 | McGowen et al. | 166/117.5 |
| 3,788,397 | 1/1974 | Terral et al. | 166/117.5 |
| 3,796,259 | 3/1974 | Outhouse | 166/117.5 |
| 3,802,503 | 4/1974 | McGinn | 166/117.5 |
| 3,807,498 | 4/1974 | Terral et al. | 166/117.5 X |
| 3,807,499 | 4/1974 | Tausch et al. | 166/242 |
| 3,827,489 | 8/1974 | McGowen | 166/117.5 |
| 3,827,490 | 8/1974 | Moore | 166/117.5 |
| 3,827,493 | 8/1974 | Terral | 166/215 |
| 3,828,853 | 8/1974 | Neal | 166/117.5 |
| 3,837,398 | 9/1974 | Yonker | 166/117.5 |
| 3,867,983 | 2/1975 | Neal | 166/117.5 |
| 3,874,445 | 4/1975 | Terral | 166/117.5 |
| 3,876,001 | 4/1975 | Goode | 166/117.5 |
| 3,889,748 | 6/1975 | Tausch | 166/117.5 |
| 3,891,032 | 6/1975 | Tausch et al. | 166/117.5 |
| 3,899,025 | 8/1975 | Dinning | 166/117.5 |
| 3,958,633 | 5/1976 | Britch et al. | 166/117.5 |
| 3,965,979 | 6/1976 | Lamb | 166/117.5 |
| 3,994,339 | 11/1976 | Goode et al. | 166/117.5 |
| 4,030,543 | 6/1977 | McGinn | 166/117.5 |
| 4,033,409 | 7/1977 | Hebert | 166/117.5 |
| 4,333,527 | 6/1982 | Higgins et al. | 166/117.5 |
| 4,480,686 | 11/1984 | Coussan | 166/118.5 |
| 4,606,410 | 8/1986 | Becker et al. | 166/117.5 X |
| 4,673,036 | 6/1987 | Merritt | 166/117.5 |

*Primary Examiner*—Hoang C. Dang
*Attorney, Agent, or Firm*—Crutsinger & Booth

[57] ABSTRACT

A side pocket mandrel having an internal deflector to prevent a latch seated therein from being bent out into the open bore. Receptacle bore sub-assemblies and deflectors welded into slots cut in the mandrel body such that the interior faces of the welds can be coated with protective material.

4 Claims, 5 Drawing Sheets

PRIOR ART
US 3,994,339

SIDE POCKET MANDREL

BACKGROUND OF THE INVENTION

1. Field of the Invention

This invention relates to side pocket mandrels for use in oil wells and more particularly to an improved construction for side pocket mandrel and method of making the same.

2. Description of the Prior Art

Side pocket mandrels have in the past been connected to tubing strings and installed within the casing of a well for use in production of oil. These side pocket mandrels have an open bore through which tools can pass and an offset side pocket in which flow control devices (such as shown in U.S. Pat. No. 3,417,774) can be retrievably mounted by use of a latch device (such as shown in U.S. Pat. Nos. 3,741,601 and 3,827,493). As is well known in the industry, these mandrels typically have internal structure which cooperate with tools such as "kick over tools. " See, for example, my U.S. Pat. No. 3,876,001. These tools can be manipulated from the surface of the well to remove and install flow control devices in mandrels located down hole. There are a variety of constructions of such mandrels. Patents illustrating mandrel construction are included in the following list:

| U.S. Pat. No. | Inventor | Issue Date |
|---|---|---|
| 2,824,525 | McGowen, Jr. | Feb. 25, 1958 |
| 2,948,341 | Fredd | Aug. 9, 1960 |
| 3,603,393 | Terral et al | Sept. 7, 1971 |
| 3,741,299 | Terral | June 26, 1973 |
| 3,796,259 | Outhouse | Mar. 12, 1974 |
| 3,807,499 | Tausch et al | Apr. 30, 1974 |
| 3,874,445 | Terral | Apr. 1, 1975 |
| 3,889,748 | Tausch | June 17, 1975 |
| 3,994,339 | Goode et al | Nov. 30, 1976 |
| 4,033,409 | Hebert | July 5, 1977 |
| 4,333,527 | Higgins et al | June 8, 1982 |

Other mandrel constructions are shown in the patents referred to and cited in the above patents.

Many side pocket mandrels include a deflector structure (see for example, U.S. Pat. Nos. 3,741,299; 3,802,503 and 4,333,527). These deflectors can be positioned above the opening to the side pocket and receptacle bore. Deflectors have a ramp type upper surface to deflect larger tools into the main bore. These deflectors are normally spaced apart to allow seating of the flow control devices. These prior art deflectors have performed adequately to prevent larger tools from contacting the latch or entering the side pocket area. However, due to the spacing between the deflectors, smaller tools have, in some instances, entered the side pocket area and contacted the latch. In some instances, these smaller tools such as guides for coil tubing will hang on or wedge between the latch and side wall. Further downward jarring will bend the latch out into the open bore. This obstructs passage through the open bore and damages the latch. In some instances the latch can be broken off. These problems can result in expensive service work being required for the well.

In the construction of side pocket mandrels, it is sometimes necessary to spray the interior with a liquid or powdered coating material to form an ultra thin 6.003 to 0.012 inch) protective plastic coating. Coatings of this type are normally designed for coating tubing without internal protrusions. This coating is especially important in the exposed weld areas where the receptacle bore sub-assembly is welded to the mandrel body. In the past, the connection between the receptacle bore sub-assembly, deflectors and mandrel is such that spray coating of the welds is difficult or completely obstructed by the structure of the sub-assembly. See, for example the obstruction shown in FIGS. 3 of U.S. Pat. Nos. 3,741,299 and 3,603,393.

None of the prior art known to applicant includes a deflector structure which protects a latch from being bent out into the open bore or broken off by contact with smaller tools and none provides a mandrel structure which can be easily coated on the interior exposed welds.

SUMMARY OF THE INVENTION

The present invention is directed to an improved side pocket mandrel for use in oil wells. The side pocket mandrel has a body portion with means on each end thereof for connection to a string of tubing and an open bore extending through the mandrel in alignment with the tubing. A side pocket is provided with a receptacle bore for receiving a flow control device. The mandrel also has means for cooperating with a latch to removably mount flow control devices in the side pocket mandrel. Deflectors are mounted in the mandrel to prevent damage to the latch by tools moving through the mandrel. The deflector means has a conventional upward facing deflecting surface located above the latch to prevent larger tools from contacting the top of the latch. According to the invention, the deflectors are designed such that if a smaller tool inadvertently enters the side pocket and engages the latch, the deflectors hold the latch in place and prevent the latch from being bent out into the main bore.

According to another feature of the present invention, a receptacle bore sub-assembly is welded to the body of the side pocket mandrel during the manufacture thereof and the internal shape and location of the welds are such that the welds are unobstructed from the main bore allowing protective coating to be sprayed on the weld. The deflectors are also designed to fit in slots in the mandrel body and to allow the interior weld faces to be coated.

Other objects and advantages will become apparent upon a reading of the detailed description of the described embodiment in accordance with the accompanying drawings wherein:

DESCRIPTION OF THE PREFERRED EMBODIMENTS

Figure 1:
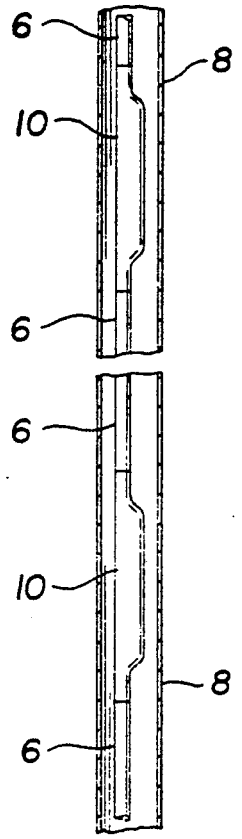
FIG. 1 is a sectional view of a partition of a well with the improved side pocket mandrel of the present invention installed therein.

The present invention will be described by referring to the attached drawings. To assist in the description, reference numerals in the drawings will be referred to and where possible the reference numerals will be used in the figures to refer to like or corresponding parts of the various embodiments of the present invention.

In FIG. 1, the improved mandrel 10 assembly of the present invention is shown in a well assembly. In use, a plurality of mandrels 10 are positioned inside well casing 8 and are connected to well tubing 6 at spaced locations for use in oil production. The mandrel 10 can be suitably connected to the well tubing 6 in numerous ways. The preferred method is by threaded connections which are shown in the drawings. It is understood that the mandrels could be connected by welding or other suitable means.

Figure 2:
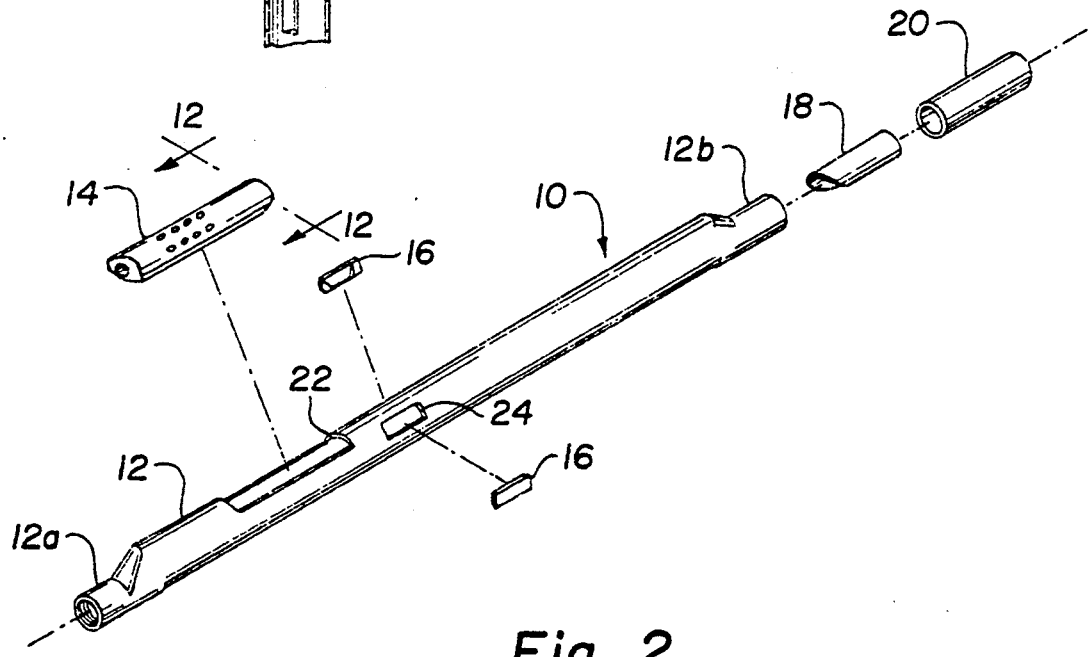
FIG. 2 is an exploded perspective view of the improved mandrel of the present invention.

The mandrel 10 is illustrated in FIG. 2 in an exploded view showing the various sub-assemblies and parts thereof before being joined together. The mandrel 10 has an elongated body 12, a receptacle bore sub-assembly 14, a pair of deflectors 16, an orienting sleeve 18 and a threaded sub-assembly 20.

Figure 3:
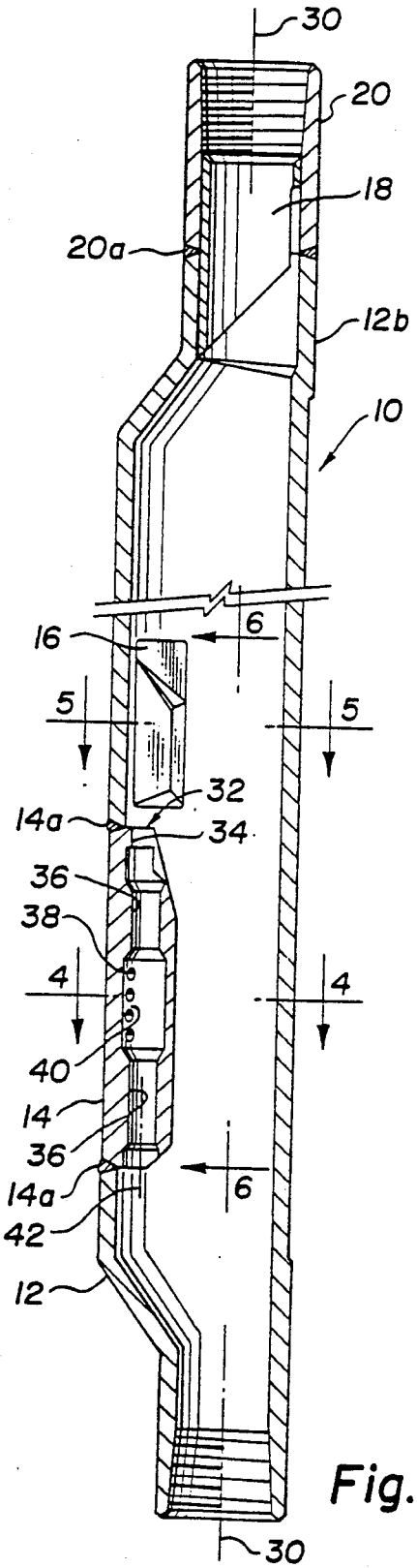
FIG. 3 is a sectional view of the improved mandrel of the present invention showing the placement of the side pocket sub-assembly, deflector, orienting sleeve and threaded sub-assembly.

In assembling the mandrel 10, the body 12 is cold formed from a tube to the oval shape shown in the FIGS. 2-5. The reduced diameter lower end 12a and upper end 12b are formed by a forging process. Mandrels of this type can be installed in a well with end 12a positioned below end 12b or alternatively with end 12b positioned below end 12a. The description of end 12a as a lower end and 12b as an upper end are used merely for purposes of convenience. It is to be understood that the lower end 12a is the end with the side receptacle bore sub-assembly 14 located between it and the deflectors 16. The upper end 12b is located on the deflector side of the side pocket mandrel sub-assembly. After the end 12a is formed, it can be suitably prepared for connection to a string of well tubing as for example by threading as shown in FIG. 3.

The orienting sleeve 18 is constructed having the usual orientating slot, with a stop shoulder at the end thereof, and a guide surface for use with a conventional orienting type "kick over tool" (not shown). The orienting sleeve 18 telescopes into and is mounted in the end 12b. The orienting sleeve 18 is sized such that its internal diameter provides a full bore opening through which tools pass with the guide surface, shoulder and slot being located radially outside of the full bore. The threaded extension 20 is of a size corresponding to the end 12b. Extension 20 is suitably prepared for connection to well tubing such as by threading as shown in the embodiment of FIG. 3. Extension 20 telescopes around the extending portion of the orienting sleeve 18 and is welded to end 12b by circumferential weld 20a (see FIG. 3). Weld 20a has sufficient penetration to provide the dual purpose of attaching the extension 20 and the orientating sleeve 18 to the mandrel body 12. Extension 20 is axially aligned with the end 12a and the interior of the body 12 such that an unobstructed full bore 30 extends longitudinally through the mandrel (see FIG. 3). As used herein, the terms "longitudinally extending" means extending at least partially in the direction of the axis of bore 30 and "transversely extending" means extending at least partially transverse to the axis of bore 30.

Figure 4:
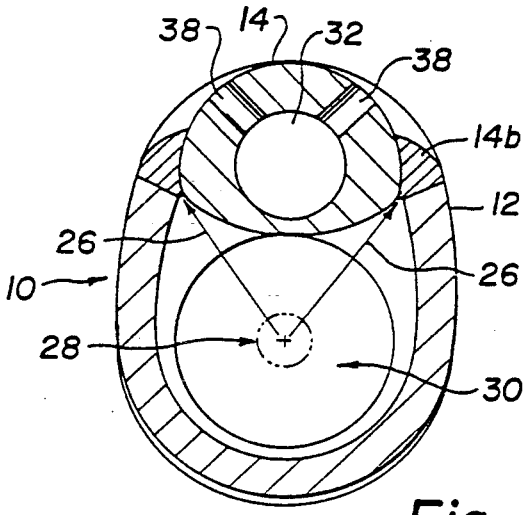
FIG. 4 is an enlarged transverse sectional view of the improved mandrel of the present invention showing a cross-section through the side pocket subassembly taken on lines 4—4 of FIG. 3 looking in the direction of the arrows.
Figure 4A:
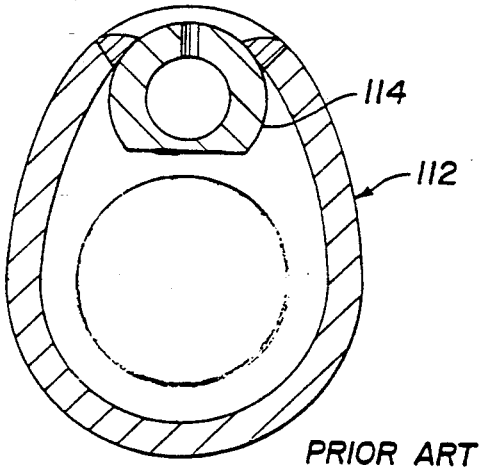
FIG. 4*a* is a view similar to FIG. 4 illustrating the prior art configuration of U.S. Pat. No. 3,994,339.

As shown in FIG. 2, a slot 22 is formed in the offset portion of the body 12. The slot 22 is of a size to receive receptacle bore sub-assembly 14. The receptacle bore sub-assembly 14 is machined prior to welding to the body 12. The receptacle bore subassembly 14 is fixed in place by full penetration welds around the periphery of the slot 22. These welds consist of two transversely extending end welds 14a and two longitudinally extending side welds 14b (see FIGS. 3 and 4). As is shown in FIG. 4, the interior exposed face of welds 14b inside of body 12 are positioned to provide an unobstructed view or line of sight 26 thereof from the center line of bore 30. This allows complete and reliable coating of the inside face of weld 14b by use of a sprayer 28 (shown in phantom lines) in FIG. 4. In the prior art device 112 shown in FIG. 4a (a sectional view from U.S. Pat. 3,994,339) coating the weld area is obstructed by the sub-assembly 14. Welds 14a are likewise positioned to provide an unobstructed view or line of sight from the center line of bore 30.

Figure 12:
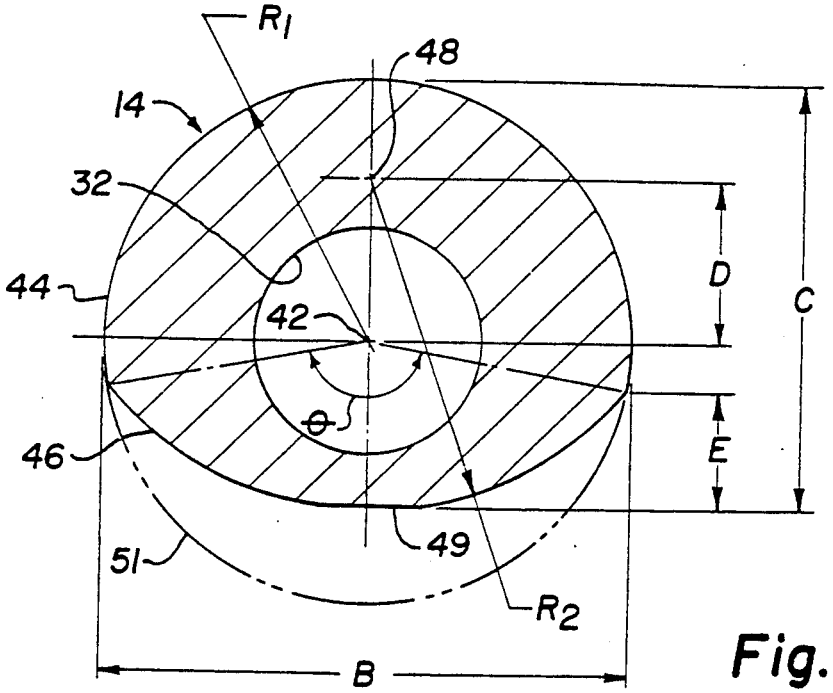
FIG. 12 is a cross sectional view of the side pocket sub-assembly taken on line 12—12 of FIG. 12.

In FIG. 12, the cross-section shape of the receptacle bore sub-assembly 14 is illustrated. The center line 42 of the bore 32 is offset in the mandrel. As shown in FIG. 12, sub-assembly 14 has two exterior curved surfaces 44 and 46. Surface 44 is cylindrical shaped with a radius $R_1$ about the center line 42. This forms a uniform wall thickness through at least about 180° arc. The remaining angle $\theta$ is 180° or less and is included by surface 46. Surface 46 is generally cylindrically shaped and is centered about center line 48. Center line 48 is spaced a distance D from center line 42. Radius $R_2$ of surface 46 is greater than radius $R_1$, thus making a nonuniform cross-section in angle $\theta$. Surface 46 can be slightly flattened at 49. As shown, the width B is greater than the height C. The location E of the lines of intersection of the surfaces 44 and 46 is at or preferably below the center line 42.

When receptacle bore sub-assembly 14 is welded in place, surface 44 will face toward the outside of the body 12. Surface 46 will be enclosed in body 12 and face inward toward the main bore. By forming surface 46 with a radius $R_2$ larger than $R_1$ and offsetting the center line 48 a distance D, surface 46 is recessed within the projected profile 51 (shown in phantom lines) of surface 44. In manufacturing the sub-assembly 14, the part is preferably forged into the shape shown in FIG. 12. Alternatively, the part could be machined to the proper shape from cylindrical or forged stock.

A pair of slots 24 (only one of which is shown in FIG. 2) are formed in the body 12 for receiving the deflectors 16. The deflectors 16 are welded to the body by full penetration welds 16a. Welds 16a extend around the periphery of the slots 24. Welds 16a are like welds 14a and b positioned for coating. Welds 16a as shown in FIGS. 3 and 5 are positioned to provide an unobstructed line of sight from the center line of bores 30 and 32.

Figure 5:
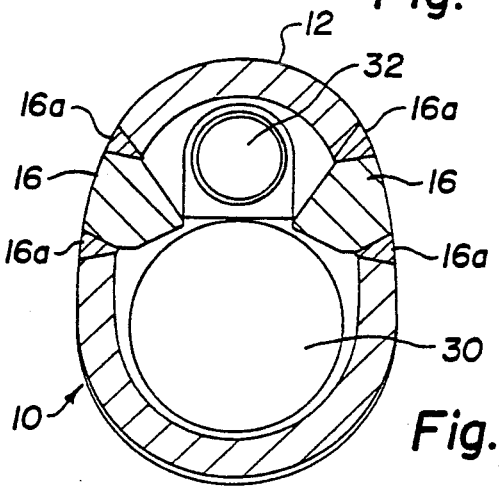
FIG. 5 is an enlarged transverse sectional view of the improved mandrel of the present invention showing the location of deflectors positioned between the receptacle bore and open bore with the section taken on lines 5—5 of FIG. 3 looking in the direction of the arrows.

The internal details of the side pocket mandrel 10 which are formed before welding are shown in FIGS. 3, 4 and 5. The mandrel has a fully open main bore 30 extending through the assembly 20. Receptacle bore 32 is smaller than and axially offset from the main bore 30. In the embodiment shown, receptacle bore 32 extends through the receptacle bore sub-assembly 14. The sub-assembly 14 is machined prior to assembly to accommodate a side pocket valve and latch of conventional structure. The receptacle bore sub-assembly has a latch shoulder 34 for a size and shape to accommodate a latch (shown in FIGS. 6 and 7) for use in mounting a retrievable flow control device in the mandrel. The receptacle bore 32 has a pair of reduced diameter seal portions 36 which are of a size to engage seals on a flow control device to be mounted in the pocket. A plurality of ports 38 extend from the receptacle bore 32 to the outside of the sub-assembly 14. Ports 38 are located in an enlarged portion 40 of the receptacle bore 32.

Figure 7:
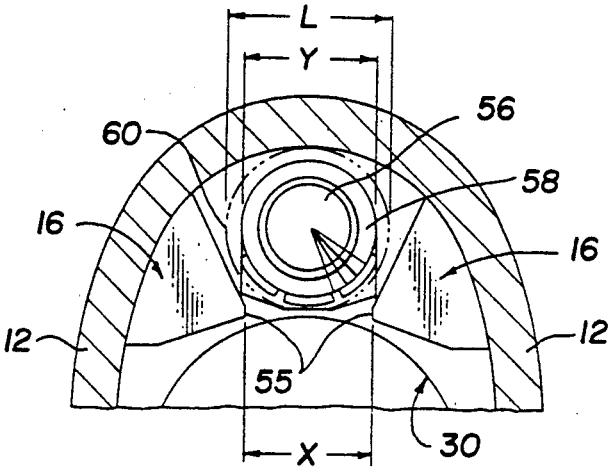
FIG. 7 is a partial enlarged transverse sectional view taken along lines 7—7 of FIG. 6 looking in the direction of the arrows showing a latch installed in the mandrel.
Figure 6:
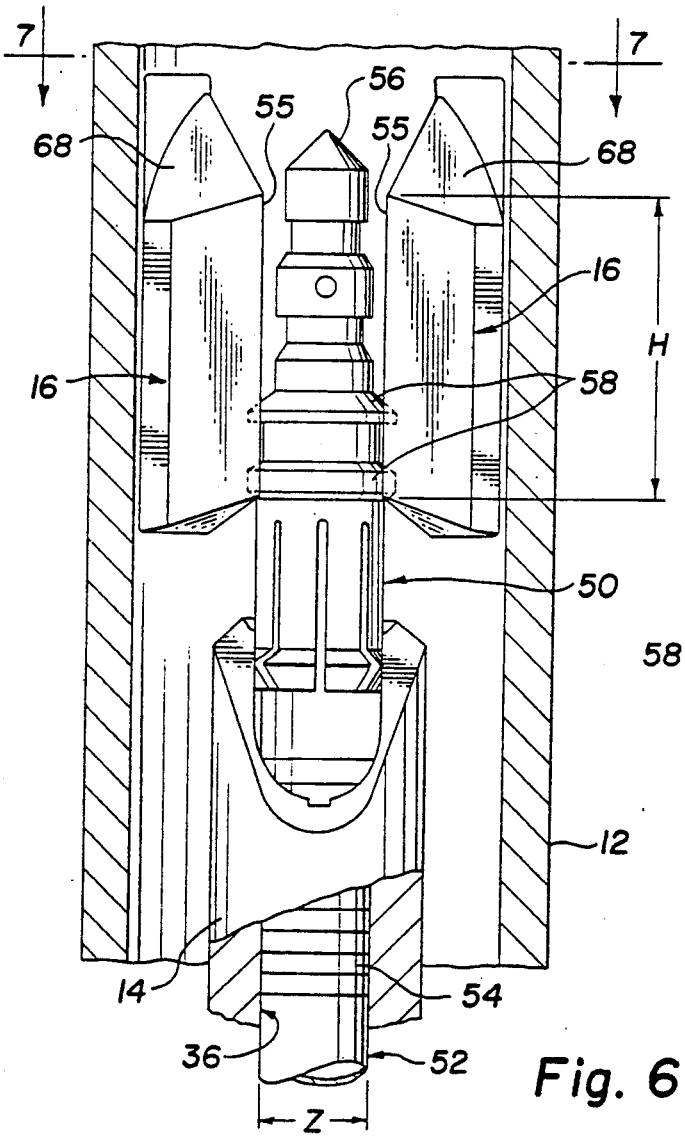
FIG. 6 is an enlarged partial longitudinal sectional view taken along lines 6—6 of FIG. 3 showing the upper part of the side pocket mandrel sub-assembly and the deflectors with a latch and flow control device installed in the mandrel.
Figure 6A:
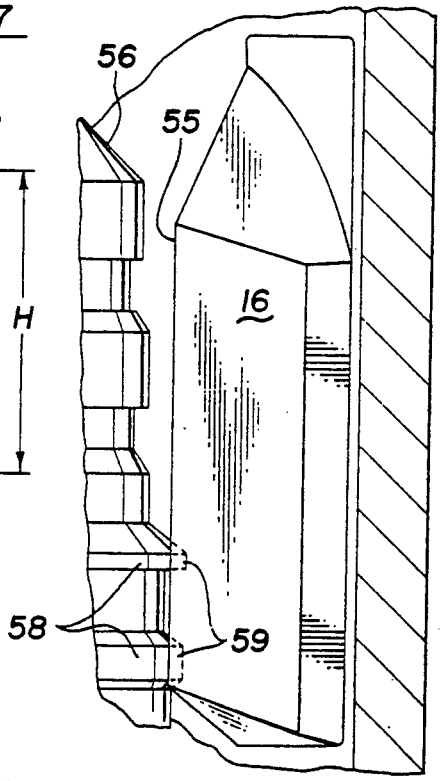
FIG. 6a is an enlargement of a portion of FIG. 6.

The relative positions of the deflectors 16 and the receptacle bore sub-assembly 14 is illustrated in FIGS. 6, 6a and 7. In FIGS. 6, 6a and 7, a latch 50 is shown attached to the upper end of a flow control device 52. The assembly extends into the receptacle bore 32 with seals 54 engaging the seal surface 36.

Latch 50 can be one of many commercially available latches for use in side pocket mandrels. The latch illustrated in the drawings is of the type manufactured by Teledyne, Inc. and is described in U.S. Pat. No. 3,741,601, the details of which are incorporated herein by reference. It is to be understood of course that the mandrel of the present invention could be utilized with other types of latches, such as is shown in U.S. Pat. No. 3,827,493. For purposes of description of the present invention, it is sufficient to note that the latch 50 when in place protrudes out from the receptacle bore. The distance a latch extends out from the bore 32 varies with the latch design and latch position with respect to latch shoulder 34. The illustrated latch has a reduced diameter running head 56 and at least one larger diameter portion 58.

As previously described in prior art devices, tools moving through the main bore 30 have on occasions caught on and damaged the latch 50 by bending the latch into the open bore. This was true even though prior deflectors were placed adjacent and above the latch to form a latch envelope around the protruding portion of the latch as such deflectors have deflection surfaces thereon to deflect tools moving down hole away from the latch. However, the deflector surfaces were not entirely effective to prevent smaller tools from extending into the latch envelope and engage or wedge between the mandrel wall and the latch.

According to the present invention, deflectors 16 are positioned to form an envelope to partially surround or enclose the latch to prevent the latch from being bent out into the main bore. In FIG. 7, surface means on deflectors form the edges of a slot extending between the lines 55. This slot forms a passageway between the latch envelope and the main bore. The clearance between the lines 55 is shown as dimension X. Dimension X is the maximum diameter of tools that can pass through the slot formed between the deflectors 16. The diameter of the latch portion 58 is shown in FIG. 7 by dimension Y. According to the present invention, it is critical that the clearance X be selected to be smaller than diameter Y of portion 58. This insures that interference contact would prevent the latch 50 from passing between deflectors 16. The latch when installed in the latch envelope is prevented from being bent out through the slot formed between the deflectors 16 and into the open bore. The bending of the latch out into the open bore is prevented by interfering contact 59 (see dotted portion in FIG. 6a) between the deflector 16 and the portion 58. If desired, the amount of interfering contact 59 could be increased by adding or further enlarging portions of conventional prior art latchings. Preferably, the dimension X is also selected to be larger than the diameter Z of the flow control device 52. During the installation procedure the flow control device 52 can pass in a radial direction from the open bore through the clearance X and into axial alignment with the receptacle bore 32. As can be seen in FIG. 6, deflectors 16 are positioned in the mandrel 10 at a height above the receptacle bore sub-assembly such that lines 55 extend through a range of heights H. This range H defines the upper and lower limits of the latch envelope formed behind the deflectors 16. It is to be understood that the upward extension of the deflectors 16 and the deflector surfaces 68 should exceed the running head 56. The range H of the latch envelope and lines 55 is selected to at least include the range of positions of the larger portion 58. This range H should overlap all possible positions of the enlarged portion 58 when the latch 50 is installed. In this manner no matter how the latch is installed the larger portion 58 will be protected in the latch envelope.

As shown in FIG. 7, deflectors 16 taper away from the minimum clearance X to define the latch envelope illustrated by a phantom line circle 60 having a diameter L. The diameter of the latch envelope 60 is defined by the largest circle which will fit in the area behind deflectors 16. According to the present invention, the latch envelope 60 has a diameter L larger than the clearance opening X.

The dimension Z as used herein defines the maximum diameter of the flow control device 52. The maximum diameter Z of the flow control device will be slightly different from the diameter of the receptacle bore 36. If compressible seals are used on the flow control device, the maximum diameter Z will be slightly larger than the diameter of the sealing portion 36 of the receptacle bore. According to the invention clearance X is greater than diameter Z to allow the flow control device 52 to pass through the slot formed between the deflectors 16. If the clearance X is large enough to allow passage of the flow control device 52 therethrough, the clearance X will in turn be larger than the receptacle bore sealing portion 36.

Figure 8:
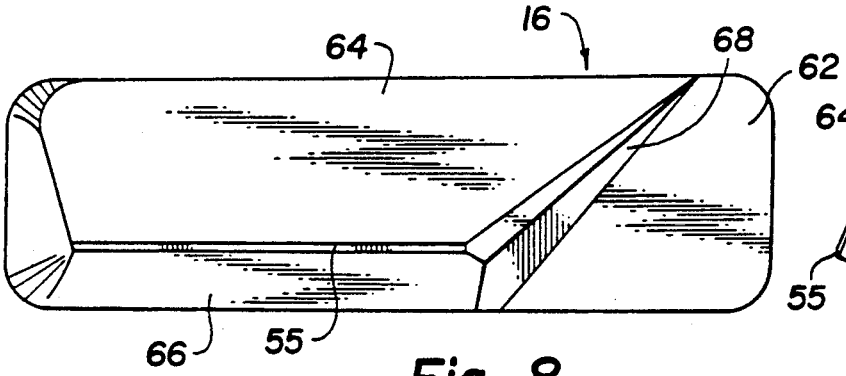
FIGS. 8, 9 and 10 are views having the configuration of the deflector.
Figure 10:
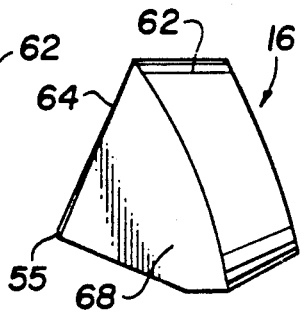
Figure 9:
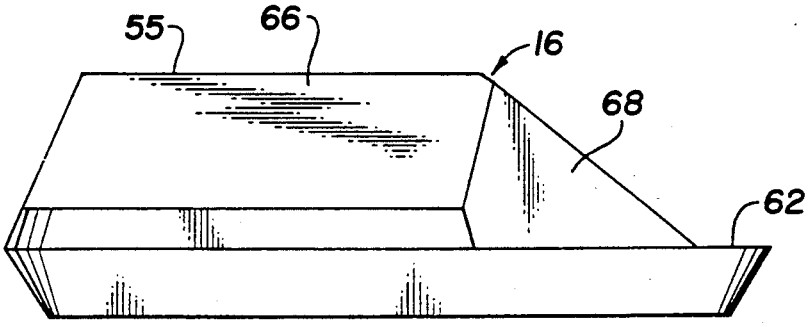

The details of the construction of the right hand deflector 16 shown in the embodiment of FIG. 7 is shown in FIGS. 8, 9 and 10. It is to be understood that the left hand deflector 16 would be a mirror image of the right hand deflector. Deflector 16 has a generally rectangular shaped base 62 of a size and shape to fit in slots 24. The base 62 is used to attach the body 12 by welding to the mandrel. Protruding from the base 62 is an interior inclined surface 64. Surface 64 faces toward the receptacle bore when installed in the mandrel. An exterior inclined surface 66 faces toward the open bore when installed in the mandrel. Deflector surface 68 is positioned on deflector 16 on the end opposite receptacle bore sub-assembly 14. Surface 68 engages and deflects larger tools away from latch envelope 60. When deflector 16 is installed, surface 68 is inclined in a downward direction toward the open bore as shown in FIG. 8. Deflector surface 68 provides a dual function. Surface 68 engages and deflects larger tools from entering the latch envelope 60. In addition, the incline of surface 68 toward the center of the mandrel helps guide a flow control device into centerline alignment with the bore 32.

Figure 11:
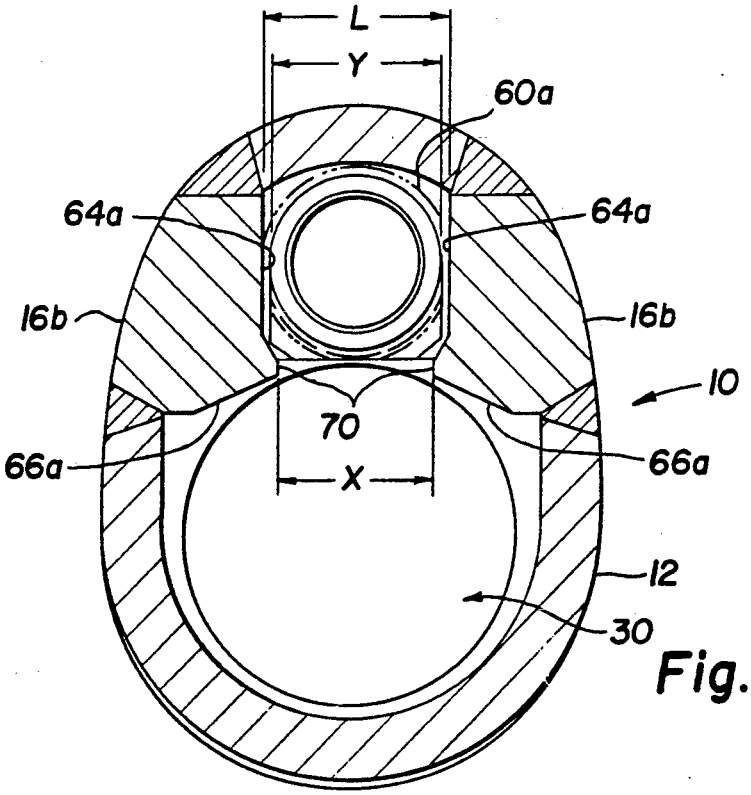
FIG. 11 is a view similar to FIG. 7 showing an alternate configuration for the deflectors of the improved mandrel of the present invention.

In FIG. 11 an alternate embodiment **16*b* of the deflector is shown installed in a mandrel 10 to extend through the length H as described with respect to FIG. 6. The deflector 16*b* is virtually identical to the deflector shown in the earlier figures except as shown in a cross section of FIG. 11. Deflector 16*b* forms a latch envelope L which has straight sides that extend in a direction toward the main bore 30. Clearance opening X is formed by two protrusions 70 which extend axially along the length of the intersection between surfaces 64a and 66a. Protrusion 70** extends into the mandrel a sufficient distance to define a clearance X which is smaller than Y the maximum diameter L of the latch and smaller than the latch envelope. The distance X is also larger than the maximum diameter of the flow control device as it was previously described. In the past, protrusions of this general shape have been located on deflectors but they lacked the critical limiting spacing in the latch envelope to prevent passage of the latch through the space.

It should be appreciated that unitary deflector means such as, for example, the one shown in FIGS. 3 and 5 of the Terral Pat. No. 3,741,299 or multiple piece deflector means of other shapes could be modified or designed in accordance with the present invention to partially surround the latch and protect it from damage by interfering contact with tools moving through the bore. In addition other shapes of receptacle bore sub-assemblies or deflector means could be designed according to the present invention to provide for coating of the interior face of the welds. Therefore it should be understood that the foregoing relates only to the preferred embodiments of the present invention and that it is anticipated that numerous alterations, modifications and changes can be made in the design of the present invention without departing from the spirit and scope of the claims appended hereto.

What is claimed is:

1. An improved combination of a side pocket mandrel assembly, a valve for mounting in the side pocket mandrel and a latch for holding the retrievable valve in place in the mandrel; said mandrel comprising a body section having a main bore extending therethrough and a receptacle bore extending along side said main bore, a latch envelope in said body section, are receptacle bore being of a size to receive said valve therein, latching surface means adjacent one end of said receptacle bore for engaging said latch to releasably mount said valve in said receptacle bore with said latch extending from said receptacle bore into said latch envelope, deflector means mounted in said body section between said latch envelope and said main bore, said deflector means defining a passageway extending between said latch envelope and said main bore, said passageway being in the shape of a slot, the minimum width of the slot measured transverse to the axis of the said main bore is greater than the diameter of valve whereby the valve can pass through said passageway, said minimum width of said passageway being less than the maximum diameter of said latch whereby said latch is prevented from passing from said latch envelope into said main bore.

2. The mandrel of claim 1 wherein said deflector means comprises a pair of spaced deflectors.

3. The mandrel of claim 2 wherein surface means on said deflector form the edges of said slot.

4. The mandrel of claim 2 wherein said deflectors are welded in slots formed in said body section.

* * * * *

UNITED STATES PATENT AND TRADEMARK OFFICE

CERTIFICATE OF CORRECTION

PATENT NO. : 5,137,085

DATED : August 11, 1992

INVENTOR(S) : William B. Goode

It is certified that error appears in the above-indentified patent and that said Letters Patent is hereby corrected as shown below:

In column 1.line 65, change "6.003" to --(.003 --;

In column 2, line 62, change "subassembly" to -- sub-assembly --;

In column 8, line 18, change "in said body section, are" to -- in said body section, said --;

In column 8, line 30, change "than the diameter of valve" to --than the diameter of said valve--.

Signed and Sealed this

Twenty-sixth Day of October, 1993

*Attest:*

BRUCE LEHMAN

*Attesting Officer*

*Commissioner of Patents and Trademarks*